United States Patent [19]

Odenthal

[11] 4,142,128

[45] Feb. 27, 1979

[54] BOX-SHAPED SCAN EXPANSION LENS FOR CATHODE RAY TUBE

[75] Inventor: Conrad J. Odenthal, Portland, Oreg.

[73] Assignee: Tektronix, Inc., Beaverton, Oreg.

[21] Appl. No.: 788,474

[22] Filed: Apr. 18, 1977

[51] Int. Cl.[2] ..... H01J 29/56; H01J 29/46

[52] U.S. Cl. ..... 315/15; 315/17; 313/429; 313/460

[58] Field of Search ..... 315/15, 17, 376; 313/429, 460

[56] References Cited

U.S. PATENT DOCUMENTS

| | | | |
|---|---|---|---|
| 2,412,687 | 12/1946 | Klemperer | 313/460 |
| 3,023,336 | 2/1962 | Frenkel | 313/433 |
| 3,496,406 | 2/1970 | Deschamps | 313/429 |
| 3,710,173 | 1/1973 | Hutchins et al. | 315/13 ST |
| 3,712,998 | 1/1973 | Mauck | 315/17 |

*Primary Examiner*—Theodore M. Blum
*Attorney, Agent, or Firm*—John D. Winkelman

[57] ABSTRACT

A cathode ray tube is provided with a rectangular box-shaped lens intermediate the tube's screen and beam deflection plates for amplifying beam deflections in both the horizontal and vertical axes. In one form, useful in either monoaccelerator or PDA tubes, the lens includes four tubular elements disposed end-to-end and spaced apart a sufficient distance to isolate them electrically. The adjacent ends of each pair of the elements are oppositely curved to provide electron lenses having vertical cylindrical mid-surfaces. The radii of the cylindrical surfaces and the voltages applied to each element are adjusted to provide a lens system that produces minimum distortion and optimum linearity in the resultant display.

13 Claims, 9 Drawing Figures

FIG. 1
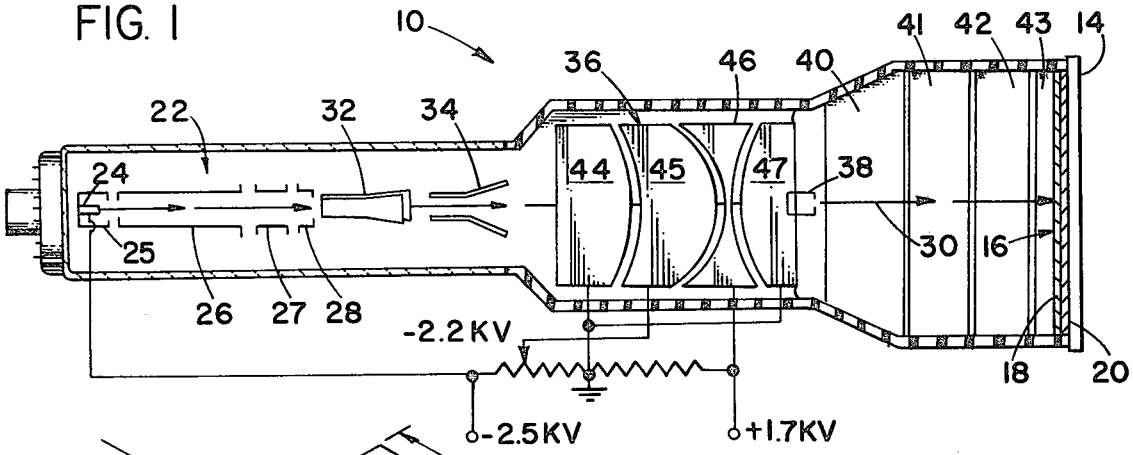
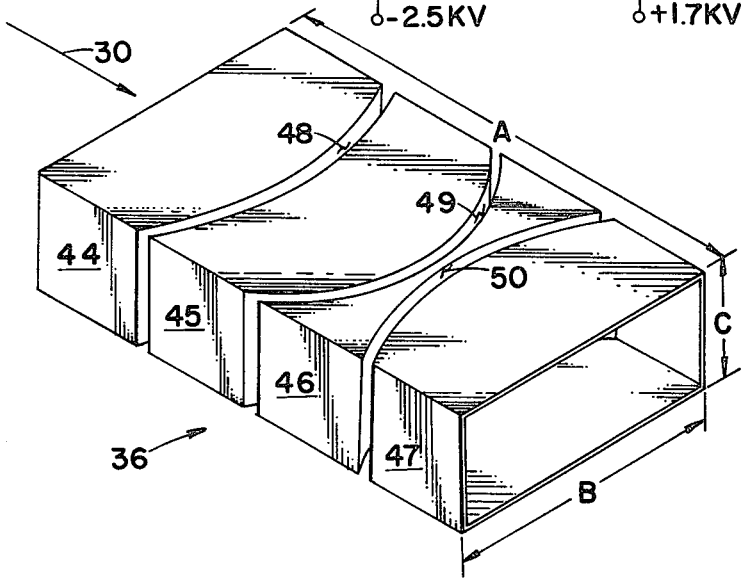
FIG. 2
FIG. 6
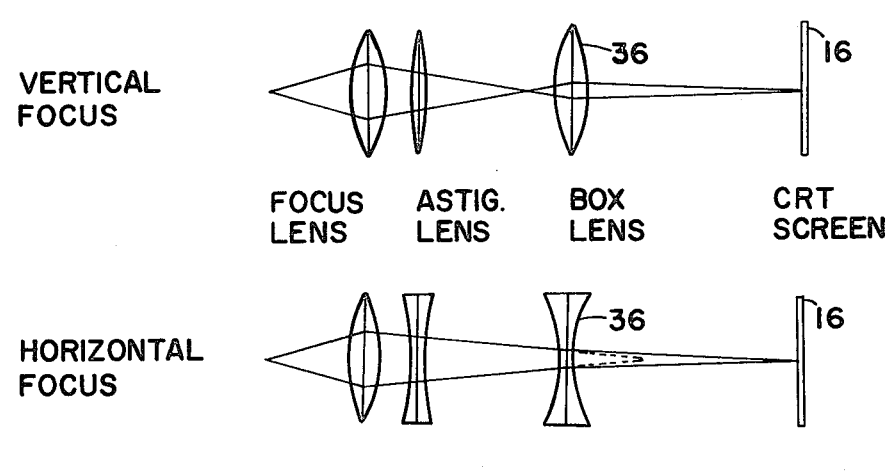

FIG. 7
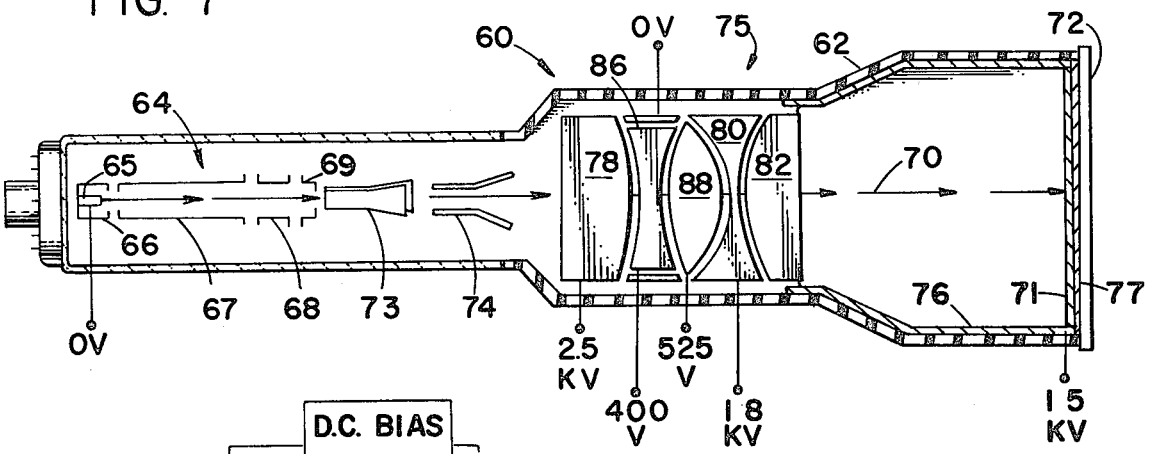
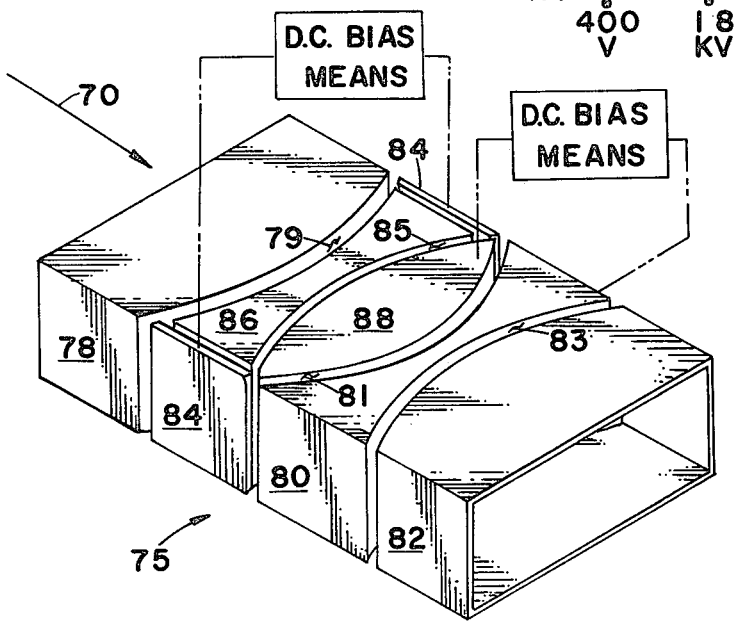
FIG. 8
FIG. 9
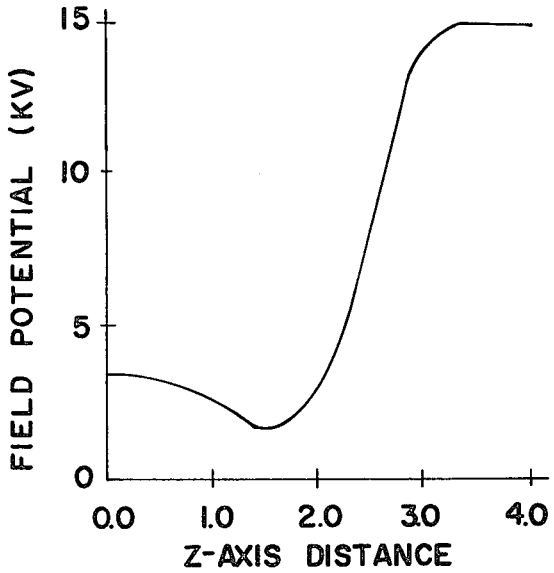

BOX-SHAPED SCAN EXPANSION LENS FOR CATHODE RAY TUBE

BACKGROUND AND OBJECTS OF THE INVENTION

The present invention relates generally to cathode ray tubes of the type that include electron lenses for amplifying deflections of their electron beams, and more particularly to an improved box-shaped scan expansion lens for such tubes.

Much work has been done in recent years to produce shorter, large screen oscilloscope CRTs having high deflection sensitivities and good spot characteristics. To obtain the required deflection sensitivity, some form of deflection amplification, also referred to as scan expansion or scan magnification, is required in such tubes. One of the more popular ways to achieve this has been to use a dome-shaped mesh to modify the field between the deflection plates and screen of a CRT, as disclosed, for example, in U.S. Pat. No. Re. 28,223 to Odenthal et al. While capable of producing excellent display characteristics, such meshes intercept a portion of the tube's electron beam. This causes a reduction in beam current, and hence in writing speed, a loss of contrast due to secondary emission from the mesh, and defocusing of the spot.

These limitations of the domed mesh can be overcome by the use of a three-element axially symmetric lens, such as that described by Schackert in *IEEE Transactions on Electron Devices,* Vol. ED-18, No. 8 (Aug. 1971), or by the use of electrostatic quadrupole lenses, such as described in U.S. Pat. No. 3,496,406 to Deschamps. Because of limitations imposed by its axial symmetry, and because the horizontal and vertical deflection centers are imaged by the lens in different ways, the three-element lens cannot achieve the geometry and linearity characteristics required for a precision oscilloscope display. Quadrupole scan expansion lenses, while capable of producing good display characteristics, require the use of an additional quadrupole, located between the horizontal and vertical deflection plates, to obtain proper focus. This imposes restrictions on deflection plate length, limiting performance.

All of the just-described scan expansion lens systems are designed for use in CRTs having post deflection acceleration (PDA). Thus, in addition to their other drawbacks, none of these systems is suitable for use in monoaccelerator tubes, such as storage CRTs.

A further type of electron lens, not heretofore utilized for deflection amplification, is disclosed in U.S. Pat. No. 2,412,687 to Klemperer. The patent describes several electron lens systems, including one consisting of multiple aligned tubular lens-forming electrodes having oppositely curved adjacent end surfaces. Such lenses are said to be useful for focusing a flat ribbon-shaped beam in a line.

It is therefore a general object of the present invention to provide an improved CRT scan expansion lens that is free from the above-mentioned disadvantages of prior art lenses.

A more specific object of the invention is to provide a scan expansion lens that is adapted for use both in monoaccelerator and PDA cathode ray tubes.

A still more specific object of the invention is to provide a box-shaped scan expansion lens comprised of axially aligned tubular elements of rectangular cross-sectional configuration, with adjacent elements being spaced apart and suitably curved along their opposed end edges to provide curved electron lenses between each pair of elements upon the application of different electrical potentials thereto.

Another object of the present invention is to provide a box-shaped scan expansion lens system that combines high deflection sensitivity and small spot size characteristics suitable for high precision oscilloscope applications.

Still another object of the invention is to provide a CRT scan expansion lens that can be adjusted to minimize display distortions.

Additional objects, features, and advantages of the present invention will become apparent as the following description of preferred embodiments thereof is read in conjunction with the accompanying drawings.

BRIEF DESCRIPTION OF THE DRAWINGS

FIG. 1 is a longitudinal section view of a cathode ray tube employing a box-shaped scan expansion lens according to one embodiment of the present invention;

FIG. 2 is an enlarged isometric view of the scan expansion lens used in the tube of FIG. 1;

FIG. 6 illustrates by optical analogy focusing of the electron beam in the FIG. 1 tube;

FIG. 7 is a longitudinal section view of a PDA cathode ray tube provided with a box-shaped scan expansion lens according to another embodiment of the invention;

FIG. 8 is an isometric view of the scan expansion lens used in the tube of FIG. 7; and FIG. 9 graphically illustrates the variation in acceleration potential along the central axis of the FIG. 8 tube.

DETAILED DESCRIPTION OF PREFERRED EMBODIMENTS

Figure 3:
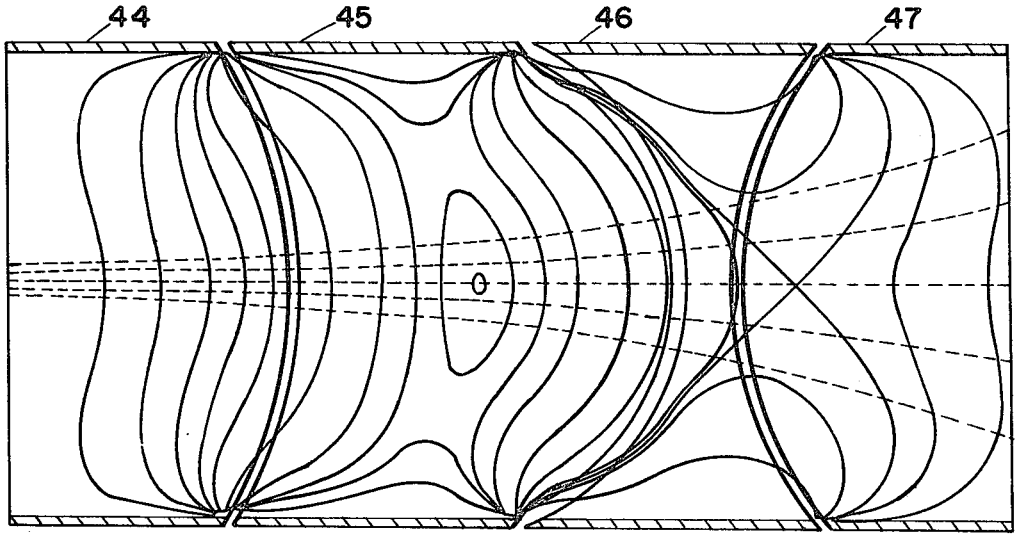
FIGS. 3 and 4 depict the equipotential lines and beam trajectories along the horizontal and vertical planes of symmetry in the lens of FIG. 2.

Referring to the drawings, and first particularly to FIG. 1 thereof, a cathode ray tube 10, herein exemplified as a storage CRT, includes an evacuated envelope 12 of glass, ceramic or other suitable insulating material. Envelope 12 is conventional in construction and includes a glass neck portion suitably sealed to a stepped ceramic funnel portion. A glass faceplate 14 supporting a storage target 16 on its inner surface is sealed to the front end of the funnel portion. Screen 16 suitably is of the type disclosed in U.S. Pat. No. 3,293,473 to Anderson, and includes a thin, porous storage phosphor layer 18 overlying a transparent conductive collector layer 20.

Suitably mounted in the neck of envelope 12 is an electron gun 22 of conventional type having a cathode 24 and control grid 25, a first anode 26, a focusing electrode 27, and a second anode 28. Gun 22 extends axially of the tube and provides an electron writing beam 30 that is directed toward the target screen through a pair of vertical deflection plates 32 and a pair of horizontal deflection plates 34 that deflect the beam in orthogonal directions, i.e., vertically and horizontally.

Disposed in the midsection of envelope 12 forward of the horizontal deflection plates is a hollow, box-shaped scan expansion lens system 36. In a manner which will be discussed in greater detail later on, lens system 36 amplifies the vertical and horizontal deflections of the electron beam to provide full coverage of screen 16, which has an 8 × 10 cm. display area and is spaced approximately 4.5 inches from the front of the scan expansion lens. Disposed above and below the forward end of lens system 36 are conventional flood guns 38 (one shown). The flood guns emit wide beams of low velocity electrons which bombard phosphor layer 18. A collimation system comprising conductive wall bands 40, 41, 42, and 43 is provided for uniformly distributing flood gun electrons over the storage target area.

Now referring to FIG. 2 along with FIG. 1, scan expansion lens system 36 is formed of four axially aligned tubular electrodes, including an entrance electrode 44, first and second intermediate electrodes 45, 46 respectively, and an exit electrode 47. The electrodes, which have a substantially rectangular cross-sectional configuration, are disposed end-to-end along the central axis of envelope 12, and thus along the path of electron beam 30. The opposed ends of each adjacent pair of the electrodes in lens system 36 are oppositely curved top and bottom to provide a curved gap between them having a vertical cylindrical midline. Thus, entrance electrode 44 and first intermediate electrode 45 are separated by a gap 48 that is convex toward screen 16, electrodes 45 and 46 are separated by a gap 49 that likewise is convex toward the target screen, and electrode 46 and exit electrode 47 are separated by a gap 50 that is convex toward gun 22.

In the illustrated embodiment, lens system 36 has an overall length A of 4.2 inches, a width B of 2.5 inches and a height C of 1.0 inches. The electrodes are fabricated of 0.025 inch thick flat stainless steel plates. The opposing ends of electrode 44 and 45 are curved in a horizontal arc of about 2.8 inch radius; the opposing ends of electrodes 44 and 46 are each curved in a horizontal arc of about 1.4 inch radius; and the opposing ends of electrodes 46 and 47 are each curved in a horizontal arc of about 2.4 inch radius. The gaps between each adjacent pair of electrodes is suitably about 0.050 inches, but in any event must be sufficient to prevent voltage breakdown between them.

In the operation of CRT 10, electrodes 44 and 47 are maintained at the same potential suitably about +2500 volts relative to the cathode of gun 22. Electrodes 45 and 46 are operated at a potential of +300 and +4200 volts respectively, likewise relative to the writing gun cathode. The writing gun cathode actually is maintained at a negative voltage, herein −2500 volts, so that the entrance and exit electrodes of lens system 36 are at or near ground potential, as are the flood gun cathodes. The voltage on collector layer 20 varies considerably, but is typically held at about +300 volts, with wall bands 40, 41, 42, and 43 being maintained at about +200, +150, +75 and +50 volts respectively.

Configured as described, and with the appropriate potentials applied to its electrodes, lens system 36 functions as a divergent lens of −1.3 inch focal length to amplify horizontal beam deflections 4×, and simultaneously functions as a convergent lens of +0.6 inch focal length, amplifying beam deflections in the vertical direction 4.5×. As will be understood, a wide range of focal lengths may be obtained by changing the radii and longitudinal positions of gaps 48–50 and readjusting the operating voltages of the elements.

The action of lens system 36 in a horizontal direction is further illustrated in FIG. 3 wherein the electric field equipotentials are shown as solid lines and electron beam trajectories through the system are depicted as dashed lines. It will be noted that the equipotentials along the horizontal axis generally follow the circular arcs described by the electrode gaps. It further will be seen that horizontal beam deflections are amplified only slightly as the beam passes from entrance electrode 44 to the adjacent lower voltage electrode 45, the primary action being a slowing down of the electrons to provide a very strong lens action as the beam passes from a low potential field in electrode 45 through the high potential field adjacent electrode 46.

Figure 4:
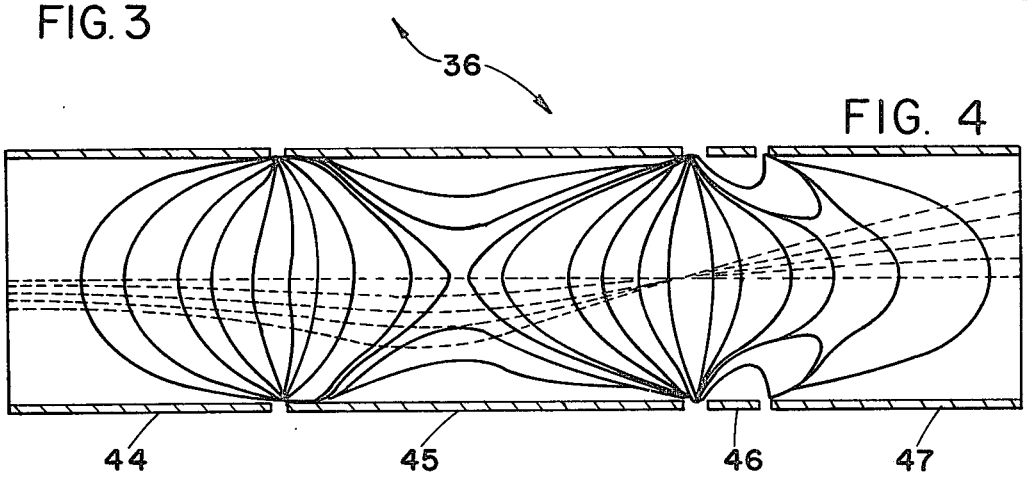
Figure 5:
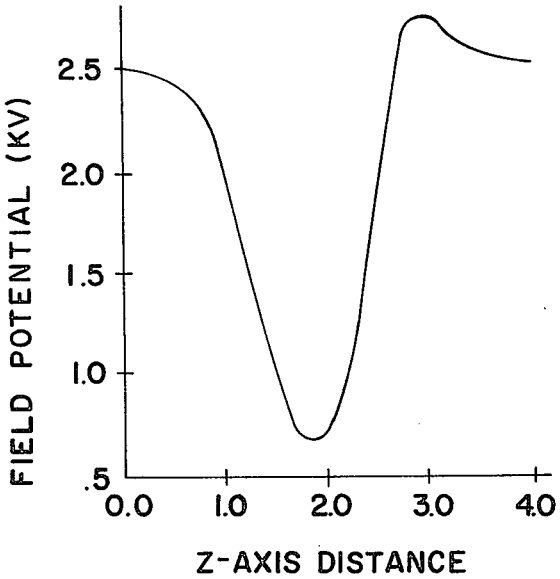
FIG. 5 graphically illustrates the variation of acceleration potential along the central axis of the FIG. 2 lens.

The action of lens system 36 in a vertical direction is illustrated in FIG. 4 in a similar manner. It will be seen that electron beam trajectories diverge as they enter the low potential portion of the lens, then converge and cross over as they traverse the high potential field portion. The accelerating field potential along the central or Z axis of the scan expansion lens system is graphically depicted in FIG. 5.

FIG. 6 illustrates by simple optical analogy how lens system 36 acts to focus electron beam 30 at screen 16. As noted above, lens system 36 has different horizontal and vertical focal lengths in the illustrated embodiment. Although these focal lengths may be varied, they are desirably chosen such that a round spot can be formed on the screen with equal magnification in both axes using the CRT focus and astigmatism controls. To achieve this in the exemplified embodiment, a real line image is formed in the vertical axis 0.7 inches in front of the lens by varying the voltages applied to focusing electrode 27 and second anode 28. This line is then imaged by the box-shaped lens onto screen 16. In the horizontal axis, a virtual line image is formed 1.0 inches behind the lens. When projected onto the screen, a round spot is formed.

As will be understood, the degree and direction of curvature of the opposed ends of electrodes 44–47, and the potentials applied to them are selected to provide minimum distortion and optimum linearity and spot characteristics in the display produced on screen 16. Changes in the horizontal focal length are made by varying the curvature of the electrode ends. Vertical scan expansion characteristics are controlled by changing the axial length and voltage applied to electrode 45.

By modifying the dimensions and shape of the electrodes, and varying the voltage applied to them, a well-corrected display can be realized in nearly any application — monoaccelerator or PDA CRTs, storage or conventional phosphor screens. Obviously, however, it is desireable to be able to vary the optical characteristics of an electron lens without changing it mechanically. This goal is achieved in an alternative embodiment of the box-shaped scan expansion lens system of the invention, which will next be described in reference to a post deflection acceleration CRT. Referring to FIG. 7, CRT 60 is similar to previously described CRT 10, and includes an evacuated envelope 62 containing an electron gun 64 comprising a cathode 65, grid 66, first anode 67, focusing electrode 68, and second anode 69. The first and second anodes are desirably connected to a source of high voltage relative to the cathode, such voltage in the particular example illustrated being about 2.5 kilovolts. Electron gun 64 provides an electron beam 70 that is accelerated by the anodes toward a phosphor display screen 71, supported by faceplate 72.

The CRT is further provided with deflection means comprising vertical deflection plates 73 and horizontal deflection plates 74 for deflecting beam 70 in orthogonal directions, and a scan expansion lens system 75 for amplifying the deflections sufficiently to cover the full viewing area of screen 71. The tube is also provided with a suitable conductive coating 76 covering the interior of the larger end of envelope 62 as shown. A transparent conductive layer 77, suitably of tin oxide, disposed intermediate phosphor screen 71 and faceplate 72 makes contact with conductive coating 76. Coating 76 is connected to a source of high voltage 15 kilovolts in the case of the present example. As will be understood, coating 76 and layer 77 cooperate to provide post deflection acceleration in the tube.

Now referring to FIG. 8 along with FIG. 7, lens system 75 includes a tubular entrance electrode 78, an intermediate electrode 80, and an exit electrode 82 that are identical with electrodes 44, 46, and 47 respectively, in previously described lens system 36. First intermediate electrode 45 in lens system 36 is replaced in lens system 75 by a structure comprised of a pair of parallel, rectangular side plates 84, parallel upper and lower bow tie-shaped plates 86, and parallel upper and lower plates 88, which have a generally elliptic shape. Each plate is electrically isolated from the others and from the adjacent tubular electrodes by suitable gaps. Thus, in addition to horizontally curved gaps 79, 81, and 83 having radii equal to gaps 48, 49, and 50, respectively, in lens system 36, box lens system 75 includes an additional horizontally curved gap 85 separating plate pairs 86 and 88. Gap 85 has a 2.1 inch radius of curvature herein, and is convex toward gun 64, as shown.

In this alternative embodiment of the box-shaped lens system, horizontal scan expansion can be changed simply by changing the voltages applied to the lens elements. For example, in lens system 36 the potential difference across gap 48 forms a field having a curvature similar to that of the gap between the entrance and first intermediate electrodes. If in lens system 75 plates 86 are connected to the same potential as the entrance electrode, but plates 88 remain connected to a much lower voltage, the field will appear across gap 85, and will be of opposite curvature. The effect is the same as mechanically changing the radii of the lens-forming electrodes. In addition, biasing voltages may be applied across the various parallel plates to change other lens characteristics. For example, keystone distortion (which may result from misalignment of the horizontal deflection plates) can be corrected by applying a differential DC bias voltage across elliptic plates 88. Vertical line bowing (caused by misalignment of the scan expansion lens with the CRT gun) can be corrected by a differential bias applied accross side plates 84. Other corrections may be made by adjusting the absolute potentials on the different plate pairs.

In the FIG. 7 embodiment, entrance electrode 78 is maintained at a potential of +2500 volts relative to cathode 65. Exit electrode 82 is electrically connected to coating 76, and thus is at screen potential, +15 kV; intermediate electrode 80 is operated at +18 kV. Side plates 84 are at or near ground potential, and plates 86 and 88 are operated at about +400 and +525 volts respectively. The accelerating field potential along the central axis of lens system 75 is shown in FIG. 9.

There is thus provided a scan expansion lens system which amply fulfills the various objectives set forth above. For example, the exemplified lens system is capable of producing an 8 × 10 cm. display having less than 0.5% geometry distortion and worst case incremental nonlinearity of 0.2%. While two preferred embodiments have been described, and possible modifications suggested, it will be appreciated that various other modifications and changes may be made within the scope of the invention as claimed.

I claim:

1. In apparatus including a cathode ray tube having a target screen, an electron gun for producing an electron beam directed toward said screen, deflection means disposed along the path of said beam for deflecting the beam in two orthogonal directions, and an electron lens system located along said path intermediate said deflection means and screen for amplifying the beam deflections, the improvement wherein said system comprises first, second, and third axially aligned tubular elements of rectangular crosssectional configuration, disposed to accomodate the passage of the beam therethrough and spaced apart a sufficient distance to isolate them electrically from one another, each of said elements including beam entrance and exit ends, one pair of opposite sides parallel to one of said orthogonal directions, and another pair of opposite sides parallel to the other of said directions, a first pair of flat plates located intermediate said first and second elements, each plate of the pair being disposed in edge adjacent, parallel relation with the corresponding sides of each element's said one pair of opposite sides, and spaced apart therefrom a sufficient distance to isolate them electrically from one another, second and third pairs of flat plates located intermediate said first and second elements, each plate of the second pair being disposed in edge adjacent, parallel relation with the corresponding sides of the first element's other pair of opposite sides, and spaced apart therefrom a sufficient distance to isolate them electrically from each other, each plate of the third pair being disposed in edge adjacent, parallel relation with the corresponding sides of the second element's other pair of opposite sides, and spaced apart therefrom, and from the corresponding plates of said second pair, a sufficient distance to isolate them electrically from one another, the opposed end edges of each adjacent pair of elements and plates being differently curved in the other of said orthogonal directions to provide a curved electron lens between each such pair upon the application of different electrical potentials thereto, said apparatus further including means for applying suitable different potentials to said elements and plates to provide a deflection amplifying lens system that is convergent in one direction and divergent in the other.

2. The apparatus according to claim 1, wherein said potential applying means includes means for applying a differential DC bias potential across the plates in at least one of said pairs to correct an undesirable display characteristic.

3. The apparatus according to claim 2, wherein means is provided for applying such a bias potential across the first pair of plates to substantially eliminate trace bowing.

4. The apparatus according to claim 2, wherein said means is provided for applying such a bias potential to a second pair of plates to substantially eliminate keystone distortion in said display.

5. The apparatus according to claim 1, wherein the electron lenses provided between said first element and second pair of plates, and between said third pair of plates and said second element, have cylindrical midsurfaces convex toward said screen, and wherein the electron lenses provided between said second and third pair of plates, and between said second and third elements, have cylindrical midsurfaces convex toward said gun.

6. The apparatus according to claim 5, wherein said lens system has different focal lengths in each of said orthogonal directions.

7. The apparatus according to claim 5, wherein said lens system has different deflection amplification factors in each of said orthogonal directions.

8. In apparatus including a cathode ray tube having means forming a target for an electron beam, means for producing such a beam directed toward said target-forming means, deflection means disposed along the path of said beam for deflecting the beam in two orthogonal directions, and an electron lens system located intermediate said deflection means and target-forming means for amplifying the beam deflections, the improvement wherein said lens system comprises successive first, second, third and fourth axially aligned sections disposed to accomodate the passage of the beam therethrough and electrically isolated from one another, each of said sections including a pair of opposed, substantially planar sides disposed parallel to one of said orthogonal directions, and another pair of opposed, substantially planar sides disposed parallel to the other of said directions, the sides of each section having end edges disposed in spaced opposition to corresponding end edges of each adjacent section, with the opposed end edges of sides parallel to at least one of said directions being oppositely curved to form an arcuate gap therebetween, the gaps between two pairs of adjacent sections being curved in one direction and the gap between the remaining pair being curved in the opposite direction, said apparatus additionally including means for applying suitable different electrical potentials to said sections to form a plurality of curved electron lenses that act in conjunction to amplify beam deflections in both of said directions.

9. The apparatus of claim 8, wherein the electron lens elements formed between said first and second sections and between said second and third sections have cylindrical midsurfaces convex toward said target-forming means and the electron lens element formed between said third and fourth sections has a cylindrical midsurface convex toward said deflection means.

10. The apparatus of claim 8, wherein said tube is a monoaccelerator tube, and wherein a first electrical potential is applied to said first and fourth sections, a second potential substantially lower than said first potential is applied to said second section, and a third potential substantially higher than said first potential is applied to said third section.

11. The apparatus of claim 8, wherein said tube is a type having a post deflection acceleration potential applied to said target-forming means, and wherein a first electrical potential is applied to the first section of said lens system, electrical potentials substantially lower than said first potential are applied to the different sides of said second section, a potential substantially higher than said first potential is applied to said third section, and a potential substantially equal to said post deflection acceleration potential is applied to said fourth section.

12. The apparatus of claim 8, wherein the curvature of the gaps between adjacent sections, the axial lengths of said sections, and the potentials applied to the different sections are chosen to provide a lens system having different focal lengths in each of said orthogonal directions.

13. The apparatus of claim 8, wherein one pair of opposite sides of a certain section comprises a first pair of flat plates and the other pair of opposite sides of said section comprises a second pair of flat plates, said first and second pairs being electrically isolated from one another to permit the application of different potentials thereto.

* * * * *